US008549811B2

(12) United States Patent
Dyson

(10) Patent No.: US 8,549,811 B2
(45) Date of Patent: Oct. 8, 2013

(54) INTERLOCKING MASONRY BLOCK

(75) Inventor: John Kenneth Dyson, Victoria (AU)

(73) Assignee: ADBRI Masonry Pty Ltd, Adelaide (AU)

( * ) Notice: Subject to any disclaimer, the term of this patent is extended or adjusted under 35 U.S.C. 154(b) by 0 days.

(21) Appl. No.: 13/334,888

(22) Filed: Dec. 22, 2011

(65) Prior Publication Data

US 2012/0159889 A1 Jun. 28, 2012

(30) Foreign Application Priority Data

Dec. 23, 2010 (AU) ..... 2010257397

(51) Int. Cl.
*E04B 2/00* (2006.01)
*E04B 5/04* (2006.01)
*E04C 2/04* (2006.01)

(52) U.S. Cl.
USPC ..... 52/604; 52/437; 52/605; 52/606

(58) Field of Classification Search
USPC ..... 52/436, 437, 505, 596, 604, 605, 606, 52/607, 608, 609
See application file for complete search history.

(56) References Cited

U.S. PATENT DOCUMENTS

| | | | | |
|---|---|---|---|---|
| 3,962,842 | A * | 6/1976 | Wilhelm | 52/436 |
| 4,485,604 | A * | 12/1984 | Palamara et al. | 52/436 |
| 5,575,128 | A * | 11/1996 | Haener | 52/572 |
| 5,715,635 | A * | 2/1998 | Sherwood | 52/286 |
| 6,226,951 | B1 * | 5/2001 | Azar | 52/604 |
| 6,591,569 | B2 * | 7/2003 | Azar | 52/604 |
| 6,962,028 | B2 * | 11/2005 | Banova | 52/592.5 |
| 8,074,419 | B1 * | 12/2011 | Humphress et al. | 52/607 |
| 2003/0014937 | A1 * | 1/2003 | Azar | 52/604 |
| 2003/0079432 | A1 * | 5/2003 | Azar | 52/604 |
| 2006/0150559 | A1 * | 7/2006 | Haener | 52/606 |
| 2009/0049788 | A1 * | 2/2009 | Thorpe | 52/605 |

FOREIGN PATENT DOCUMENTS

DE 4107188 A1 * 9/1992

* cited by examiner

*Primary Examiner* — Ryan Kwiecinski
(74) *Attorney, Agent, or Firm* — Defillo & Associates, Inc; Evelyn A. Defillo

(57) ABSTRACT

In one aspect the invention provides an interlocking masonry block including a rear face, a front face, at least one aperture extending vertically through said block for receiving a flowable concrete mixture used in core filling, and at least one generally vertical side being registerable with an opposing side of an abutting block to inhibit movement of said flowable concrete out through a vertical interface between said blocks.

18 Claims, 15 Drawing Sheets

INTERLOCKING MASONRY BLOCK

FIELD OF THE INVENTION

The present invention relates generally to the field of masonry blocks for use in the construction of walls including structural and retaining walls, and in one aspect relates to interlocking blocks having generally vertical cooperating sides that inhibit movement of flowable concrete used in core filling out through the vertical interface between the blocks.

BACKGROUND OF THE INVENTION

There are several types of masonry blocks including large hollow precast concrete blocks used in construction. The hollow blocks can be used for load-bearing walls of buildings and for the constructing of retaining walls. The hollow blocks are reinforced with core filled concrete columns and steel reinforcement bars. The blocks have one or more vertical apertures extending therethrough, and have either cast smooth sides or they may be split-faced blocks that include a rough, stone-like texture on at least one face of the block.

If the blocks are to be made into split-face blocks, they are first moulded as two blocks joined together and once cured are passed through a splitter. This causes the double block to fracture and form a rough, stone-like texture on one face of each block. Corner blocks are moulded as double blocks with end portioned that are also slit off to reveal two perpendicular sides with rough, stone-like texture.

The vertical apertures extending through the masonry blocks permit the positioning of the steel reinforcement bars and allow core fill concrete to run vertically and horizontally through the block to compensate for the lack of tensile strength of the wall.

Conventionally the masonry blocks are stacked and held together with concrete mortar to form the desired length and height of the wall. This however required the cores to be cleaned of excess mortar prior to filling with the core fill concrete. More recently interlocking concrete block systems have also been developed. These systems may include plastic locating bridges and the blocks may include moulded lugs that engage with the underside of an overlying block or blocks to thereby locate the overlying courses of blocks. The ends of the blocks are typically fixed to abutting blocks using a concrete mortar or other adhesive.

There are also various mortarless interlocking concrete block systems currently available. However the core fill concrete has a tendency to bleed out between the vertical interfaces between adjacent blocks during construction of the wall, which necessitates cleaning or rendering of the wall surface.

Furthermore, a user must still construct wooden formwork at the corners of the walls or use an adhesive such as mortar on the vertical sides of the blocks to prevent blowout that results in a block becoming dislodged from the wall. Blowout of a wall can be a costly and time-consuming problem to rectify. This increases the time required to construct the wall and means that under certain weather conditions the wall cannot be constructed.

It should be appreciated that any discussion of the prior art throughout the specification is included solely for the purpose of providing a context for the present invention and should in no way be considered as an admission that such prior art was widely known or formed part of the common general knowledge in the field as it existed before the priority date of the application.

SUMMARY OF THE INVENTION

It could broadly be understood that the invention resides in an interlocking masonry block for constructing a wall together with other masonry blocks having at least one vertical side, including a rear face, a front face, at least one aperture extending vertically through said block for receiving a flowable concrete mixture used in core filling, and at least one generally vertical side being registerable with an opposing side of an abutting block to inhibit movement of said flowable concrete out through a vertical interface between said blocks.

In one form the interlocking masonry block for constructing a wall together with other masonry blocks having at least one vertical side, including a rear face, a front face, at least one aperture extending vertically through said block for receiving a flowable concrete mixture used in core filling, and at least one generally vertical side adjoining the front face, the side having an engagement member registerable with a correspondingly shaped engagement member extending down an opposing side of an abutting block, wherein the engagement members interact to inhibit movement of said flowable concrete out through the vertical interface between the abutting blocks.

The correspondingly shaped engagement members may comprise at least one protrusion that is configured to bear against, or within, a docking member.

The interlocking masonry block preferably includes a front wall and a rear wall connected by at least one web member.

The front wall may comprise said front face, an upper bedding face, a lower bedding face, and first and second opposing generally vertical sides adjoining the front face, a longitudinal protrusion extending down the entire vertical length of said first side, and the second side having a docking member that in one form may be at least one groove extending longitudinally down the length of the face wherein the groove is correspondingly shaped to engage with said longitudinal protrusion, such that at least a portion of the protrusion bears against a side of the groove.

The longitudinal protrusion may include two flat abutment surfaces that join at an apex for bearing against a side of the correspondingly shaped groove in the side of an adjacent block.

The protrusion on the first side of one block is therefore able to positively register with the groove extending down the second side of an adjacent abutting block. In this way the blocks along a single horizontal course of blocks have interlocking vertical interfaces.

The rear wall may include a generally vertical rear face, an upper bedding face, a lower bedding face, and first and second opposing generally vertical sides adjoining the rear face. A plurality of parallel protrusions interspaced by grooves may extend longitudinally down the length of both first and second sides. The parallel protrusions and grooves on the first side of the rear wall of one block are able to register with the opposing protrusions and grooves extending down the second side of an adjacent abutting block. The front and rear walls are therefore interlocked with the adjacent blocks along a single horizontal course.

The block of the immediately preceding paragraph may be used in the construction of retaining walls wherein the front wall is of a greater thickness than the rear wall. The front wall may be split faced or moulded.

In an alternate form the rear wall may comprise said rear face, an upper bedding face, a lower bedding face, and first and second opposing generally vertical sides adjoining the rear face, the longitudinal protrusion may extend down the entire vertical length of said first side, and the second side having a docking member that in one form may be at least one groove extending longitudinally down the length of the face wherein the groove is correspondingly shaped to engage with said protrusion, such that at least a portion of the protrusion bears against a side of the groove.

The block of the immediately preceding paragraph may be used in the construction of walls for building including free-standing and load bearing walls, wherein the front and rear walls have generally the same thickness.

The rear wall may include two generally vertical break lines extending down the rear face between the web member and first side, and the web member and the second side. These two break lines permit a portion of the rear wall to be removed such that the front faces of adjacent blocks can be set at an angle greater than 180° in the horizontal plane. This is particularly useful if the wall being constructed requires a gradual curve.

The protrusion and corresponding shaped docking means of the front wall may therefore be shaped so that they are able to register with an abutting block at various angles. In one form the vertical first and second sides adjoining the front face are tapered along a horizontal plane inwardly towards said vertical aperture. The protrusion extending outwardly from the first side is dimensioned to positively register with the groove of an adjacent block at a range of angles while inhibiting movement of flowable concrete out through the vertical interface between abutting blocks. In one form the portion of the vertical side on a rear side of the protrusion is stepped back relative to the portion of the vertical side adjoining the front face.

The masonry block may include lugs that extend upwardly from the upper bedding face and engage with the underside of an overlying block. In this way an overlying second course of interlocking masonry blocks engage with lugs that extend upwardly from the upper bedding face of the underlying blocks to ensure wall stability during the laying of the blocks, placement of reinforcement rods and core filling with flowable concrete.

At least a portion of the upper boundary of the web member or members is below the upper bedding face to permit the movement of flowable concrete and the positioning of steel reinforcement tie bars onto the web members. An upper portion of the web member may be removable to permit placement of the reinforcement bars. The removable portion may be required in end blocks or corner blocks that are under particular constraints during the moulding process.

In accordance with another aspect of the invention there is proposed an interlocking corner masonry block for constructing a wall together with other masonry blocks having at least one vertical side, the corner masonry block including a rear face generally parallel a front face, a first end having an end face generally perpendicular and extending between an end of said rear and front faces, an aperture extending vertically through said block for receiving a flowable concrete mixture used in core filling, and a generally vertical second end, opposite said end face, being registerable with an opposing vertical side of a first abutting block, wherein the rear face including spaced apart engagement members extending down said rear face and registerable with a vertical side of a second abutting block having complementary shaped engagement members to inhibit movement of said flowable concrete out through a vertical interface between said corner block and said second abutting block.

The spaced apart engagement members of the rear face are preferably parallel.

In one form the second abutting block includes a side adjoining the front face and a side adjoining a rear face, wherein the sides are correspondingly shaped to register with the engagement members extending down said rear face of the corner block. The second abutting block includes a front face perpendicular to the front face of the corner block.

In accordance with yet another aspect of the invention there is proposed a method of dry stacking masonry blocks for use in a steel reinforced concrete wall including the steps of:

positioning a first course of interlocking masonry blocks on a foundation having vertical reinforcement bars extending upwardly therefrom, the blocks each including a rear face, a front face, an upper bedding face having upwardly extending lugs, a lower bedding face, at least one generally vertical aperture extending through said block for permitting passage of reinforcement bars and flowable concrete, and a generally vertical side adjoining the front face having an outwardly protrusion extending down the length of said side and registerable with a docking member extending down an opposing side of an abutting block;

positioning a second course of interlocking masonry blocks on top of the first course wherein the blocks of the second course engage with the upwardly projecting lugs that extend upwardly from the upper bedding face of the underlying blocks; and core filling said blocks by introducing a flowable concrete mixture into the interconnecting vertical apertures of the blocks, wherein the protrusion bears against the docking member to inhibit movement of the flowable concrete out between the vertical interface of abutting blocks.

In one form the method further includes the step of positioning a corner masonry block at a corner of the wall wherein the corner masonry block includes a rear face generally parallel a front face, an end face generally perpendicular and extending between said rear and front faces, an aperture extending vertically through said block, a generally vertical side opposite said end face being registerable with an opposing side of a first abutting block, wherein the rear face including parallel, spaced apart engagement members extending down said rear face and registerable with corresponding protrusions and docking members of a second abutting block.

BRIEF DESCRIPTION OF THE DRAWINGS

The accompanying drawings, which are incorporated in and constitute a part of this specification, illustrate implementations of the invention and, together with the description and claims, serve to explain the advantages and principles of the invention. In the drawings:

DETAILED DESCRIPTION OF THE ILLUSTRATED AND EXEMPLIFIED EMBODIMENTS

Figure 1:
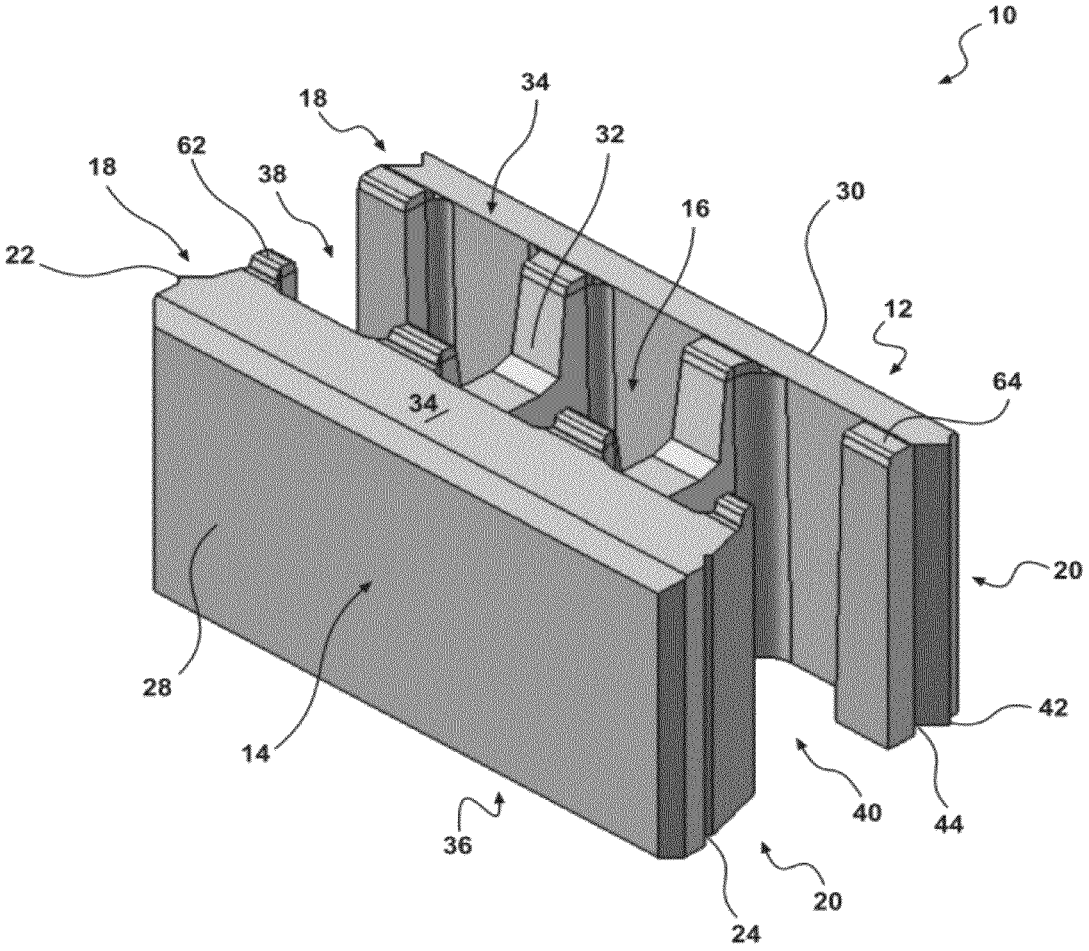
FIG. 1 is a perspective view of a masonry block of the present invention.
Figure 2:
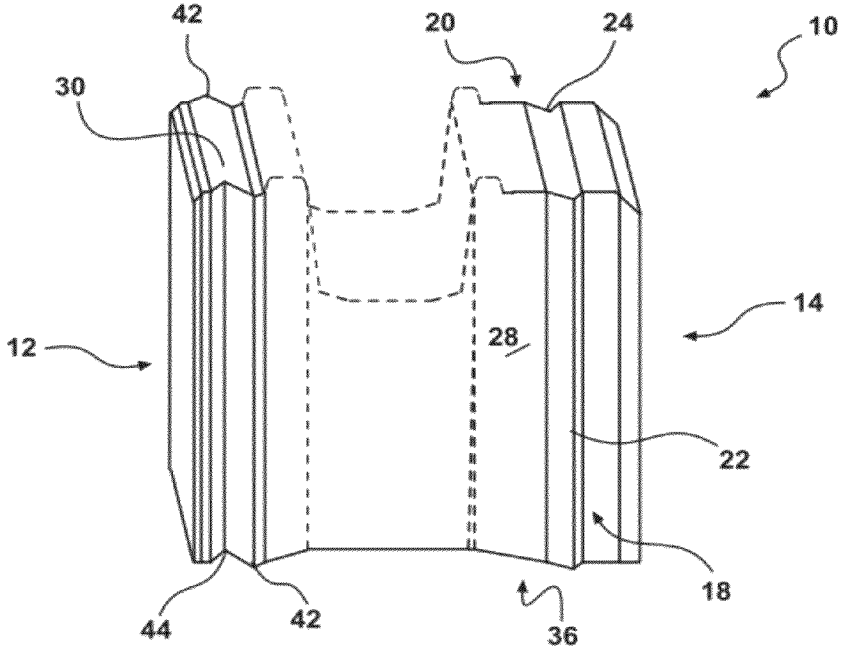
FIG. 2 is a side view masonry block of FIG. 1, illustrating the longitudinally extending protrusion and the web members in dotted lines.

There are numerous specific details set forth in the following description. However, from the disclosure, it will be apparent to those skilled in the art that modifications and/or substitutions may be made without departing from the scope and spirit of the invention. In some circumstance specific details may have been omitted so as not to obscure the invention. Similar reference characters indicate corresponding parts throughout the drawings.

As the reader will now appreciate current block systems suffer from the problem that as the concrete is introduced into the dry stacked wall during core filling the concrete has a tendency to seep out between the vertical joints or interfaces between the blocks of a single horizontal course. This has a marked affect on the aesthetic appearance of the wall. Accordingly, the front face of the wall must be cleaned or the surface must be treated to cover this seepage. This makes the existing block systems particularly inadequate for retaining walls using split faced blocks as the front face of the wall must be cleaned which can affect the split faced surface of the blocks. Furthermore, the corner of walls built using existing blocks have a tendency to blowout and therefore wooden framework or mortar must be used on the corners of the wall.

Figure 3:
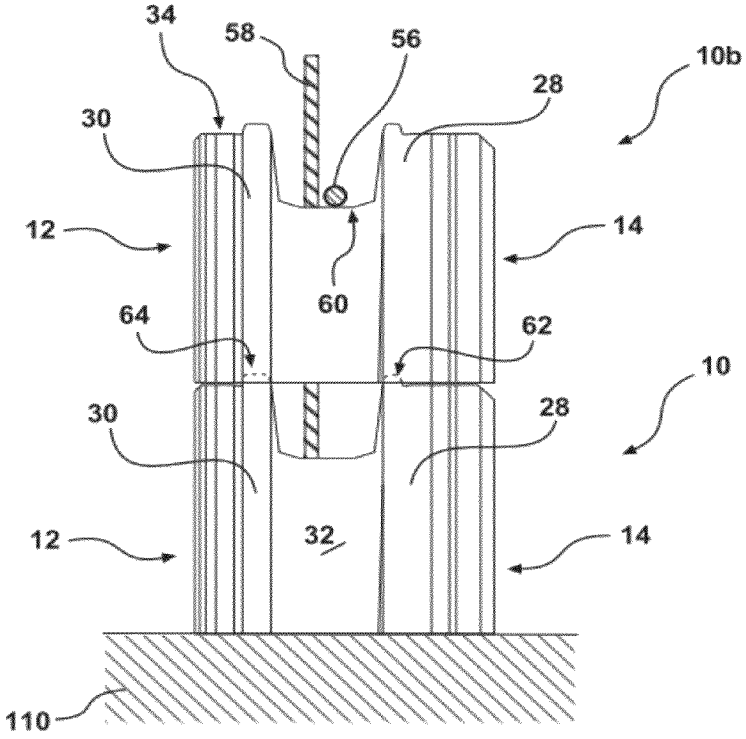
FIG. 3 is a side view of the masonry block of FIG. 1 with a second course of blocks placed thereupon.

Referring to the drawings for a more detailed description, an interlocking masonry block 10 is illustrated, demonstrating by way of examples, arrangements in which the principles of the present invention may be employed. As illustrated in FIG. 1 the standard masonry block 10 includes a rear face 12, a front face 14, aperture 16 extending vertically through the block 10 for receiving a flowable concrete mixture used in core filling, and vertical sides 18, 20 adjoining the front face 14. The side 18 includes a single longitudinally extending protrusion 22 registerable with a docking member in the form of a single groove 24 that extends down an opposing side of an abutting block 10*a* as illustrated in FIG. 3. The protrusion 22 bears against the docking member 24 to inhibit movement of the flowable concrete out through the vertical interface 26 between the abutting blocks 10, 10*a*.

As further illustrated in the figures the standard masonry block 10 includes a front wall 28 and a rear wall 30 connected by web members 32. The front wall 28 includes the front face 14, an upper bedding face 34, a lower bedding face 36, and first and second opposing generally vertical sides 18, 20 adjoining the front face 14.

The rear wall 30 includes the rear face 12, and a respective upper bedding face 34, lower bedding face 36, and first and second opposing generally vertical sides 18, 20 adjoining the rear face 12. The sides 18, 20 of the front wall 28 are separated from the sides 18, 20 of the rear wall 30 by side apertures 38, 40.

In another embodiment a plurality of parallel protrusions 42 interspaced by grooves 44 extend longitudinally down the length of both sides 18, 20 of the rear wall. The plurality of parallel protrusions 42 and grooves 44 on the first side 18 of the rear wall 12 of one block 10 are able to register with the opposing protrusions and grooves extending down the second side of an adjacent abutting block 10*a*. The front 14 and rear walls 12 are therefore interlocked with the adjacent blocks along a single horizontal course.

It should be appreciated that various interlocking members could be used without departing from the scope of the invention. In one embodiment the longitudinally extending protrusion 22 extending down the entire vertical length of the first side 18. The second side having a docking member 24 comprising a groove extending longitudinally down the length of the second side 20 wherein the groove 24 is correspondingly shaped to engage with the protrusion 22, such that at least a portion of the protrusion 22 bears against a side of the groove 24. This is however only one possible embodiment and multiple protrusions and grooves could be used on the opposing sides adjoining the front and rear face.

Figure 4A:
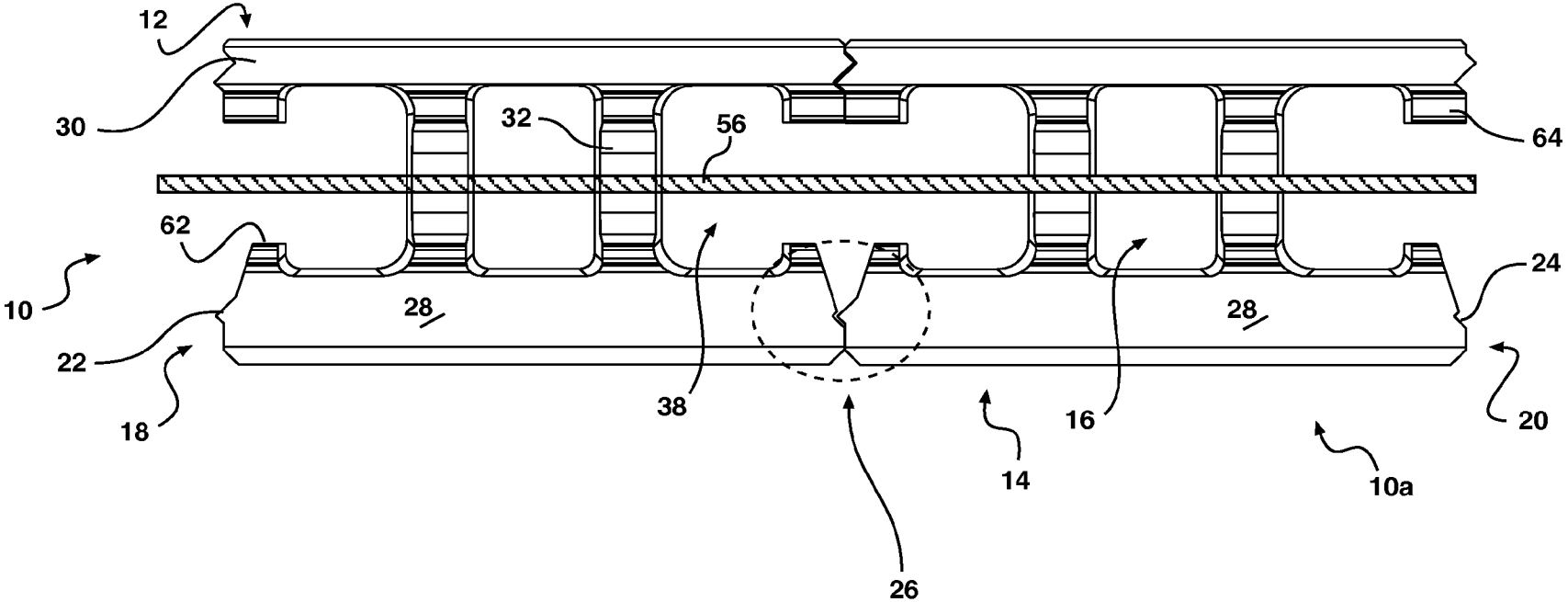
FIG. 4*a* is a top view of the masonry block of FIG. 1 positioned beside a second masonry block.
Figure 4B:
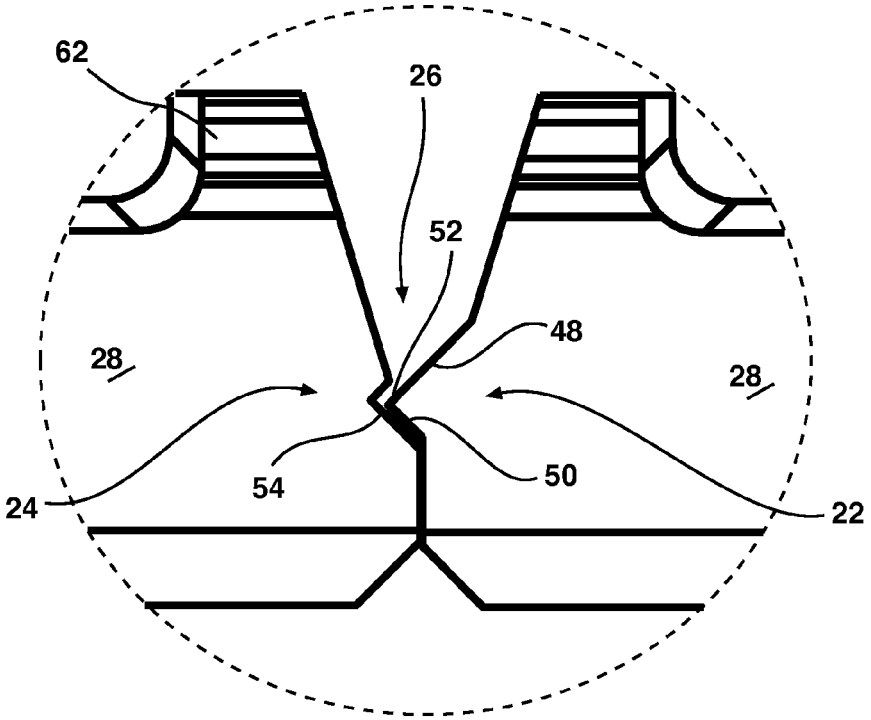
FIG. 4*b* is an engagement view of the vertical protrusion with the docking means of the abutting block.

As illustrated in FIG. 4 the protrusion 22 may in one embodiment include two flat abutment surfaces 48, 50 that join at an apex 52 for bearing against a side 54 of the correspondingly shaped groove 24 in a side 20 of the adjacent block 10*a*.

The reader will now appreciate that the protrusion on the first side of one block is able to positively register with the groove extending down the second side of an adjacent abutting block. In this way the blocks along a single horizontal course of blocks have an interlocking vertical interface that inhibits the movement of concrete therethrough.

As further illustrated in FIGS. 3 and 4, horizontal steel reinforcement rods 56 are supported on the web members 32. In a stacked arrangement, as illustrated in FIG. 3, the corresponding apertures 16, 38, 40 of blocks 10, 10*b* interconnect to permit the passages of vertical steel reinforcement rods 58.

As further illustrated in FIG. 3, the web members 32 have at least a portion of the upper boundary 60 below the upper bedding face 34 to permit the movement of flowable concrete and the positioning of the horizontal steel reinforcement rods 56.

The masonry block 10 may include lugs 62, 64 that extend upwardly from the upper bedding face 34 and engage with the underside of an overlying block 10*b* as illustrated in FIG. 3. In this way an overlying second course of interlocking masonry blocks engage with lugs 62, 64 that extend upwardly from the upper bedding face 34 of the underlying block 10 to ensure wall stability during the laying of the blocks, placement of reinforcement rods and core filling with concrete. Although four lugs are illustrated as being attached to the front wall and four to the rear wall it should be appreciated that the number, location and dimension of the lugs could be changed without departing from the scope of the patent.

The embodiment disclosed in FIGS. 1 to 4 includes a thickened front wall 28 with the blocks being used in the construction of retaining walls. The front wall 28 may be split faced or moulded as is known in the art.

Figure 5:
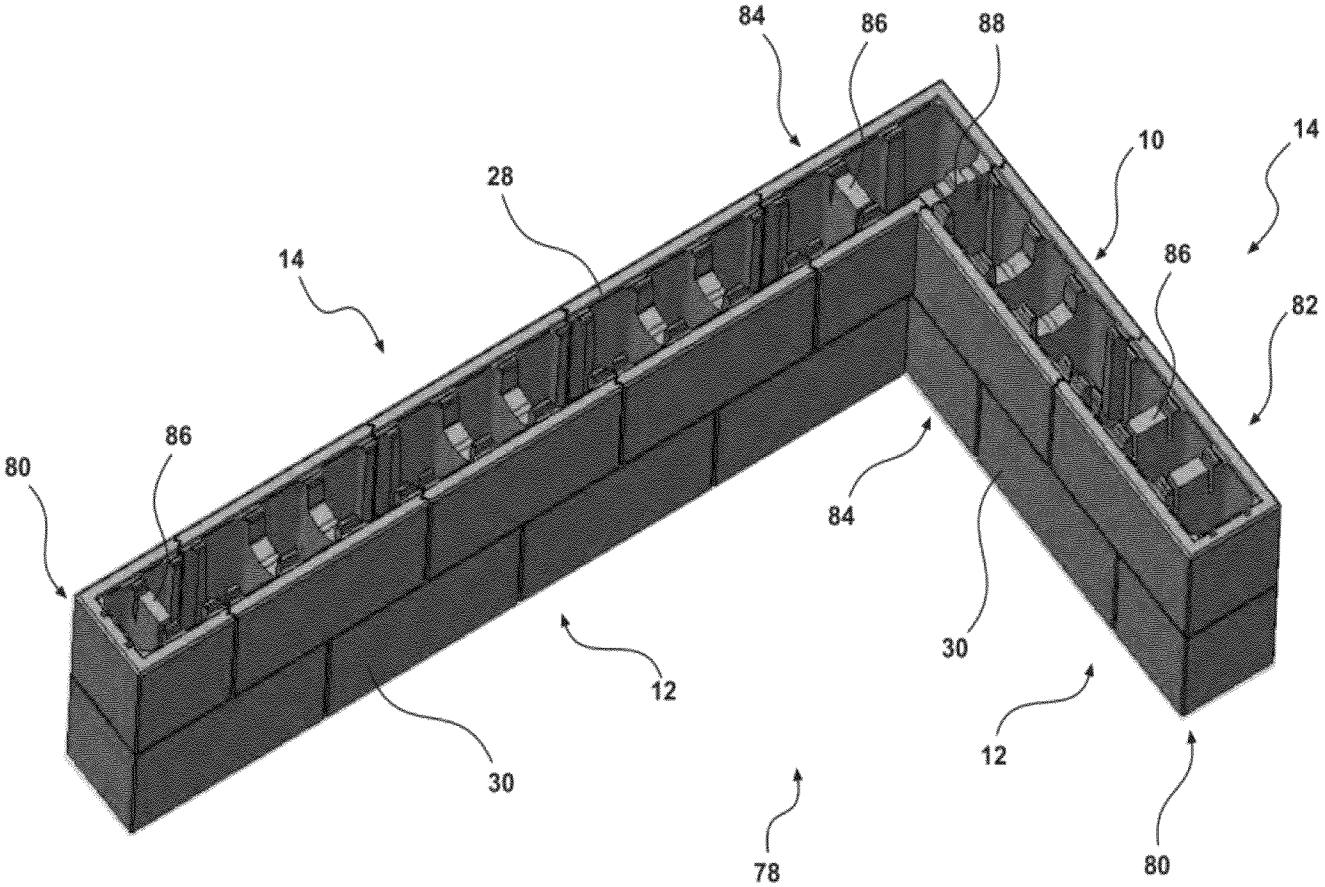
FIG. 5 is a perspective view of a wall constructed using a second embodiment of the masonry block, illustrating end half blocks and a corner block.

In another embodiment, as illustrated in FIG. 5, the front and rear walls 28, 30 of blocks 10 have generally the same thickness. The blocks 10 illustrated in FIG. 5 can be used in the construction of walls for buildings, load bearing walls or free standing partition walls.

As further illustrated in FIG. 5, the subsequent courses of blocks are vertically offset so that each standard block interlocks with two overlying blocks. To construct the wall 78, half and full end blocks 80, 82 and corner blocks 84 must be used. The respective web members 32 of blocks 80, 82, 84 may include a removable upper portion 86 that can be broken off to permit placement of the reinforcement bars 56 and allow the flow of concrete during core filling. The rear wall 30 of the corner block 84 may also include a removable portion 88 that can be broken off to likewise permit placement of the reinforcement bars 56 and the flow of concrete during core filling. The removable portions 86, 88 are required in end blocks and corner blocks due to constraints during the moulding process, however it should be appreciate that the removable portions are not essential.

The reader should appreciate that the front and rear walls may have a similar thickness and the rear wall may include a single protrusion that engage with single groove in a corresponding block or the sides may include a plurality of protrusions or ridges and grooves as illustrated for the rear wall in FIG. 3.

Figure 6:
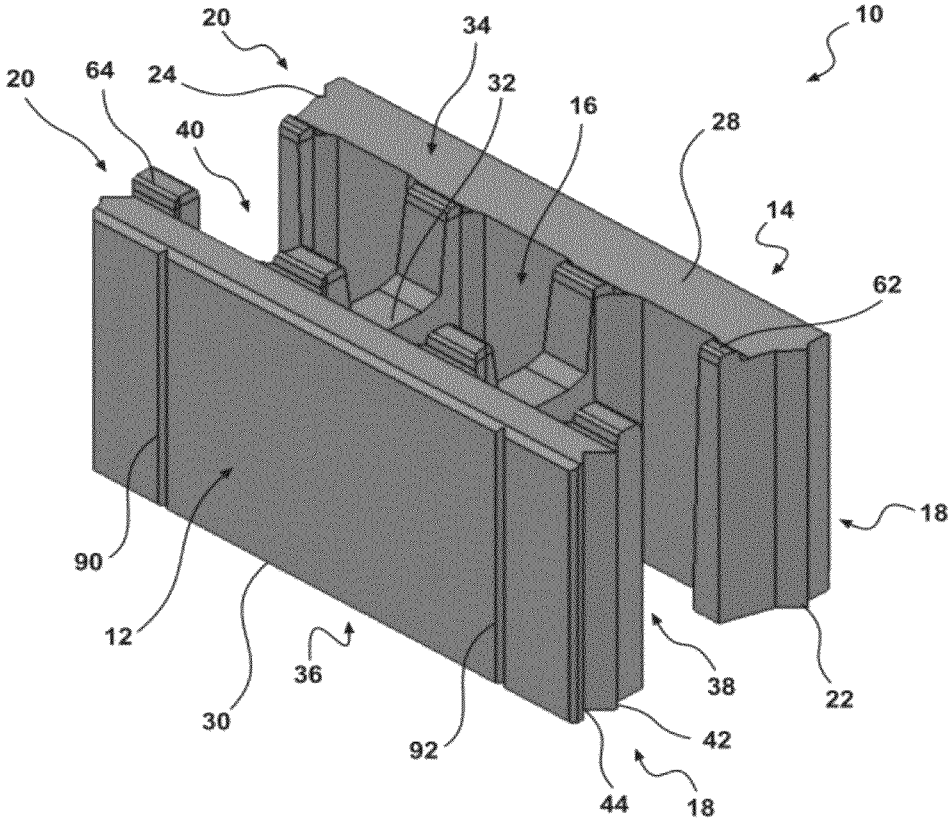
FIG. 6 is a perspective view of a third embodiment of the masonry block.
Figure 7:
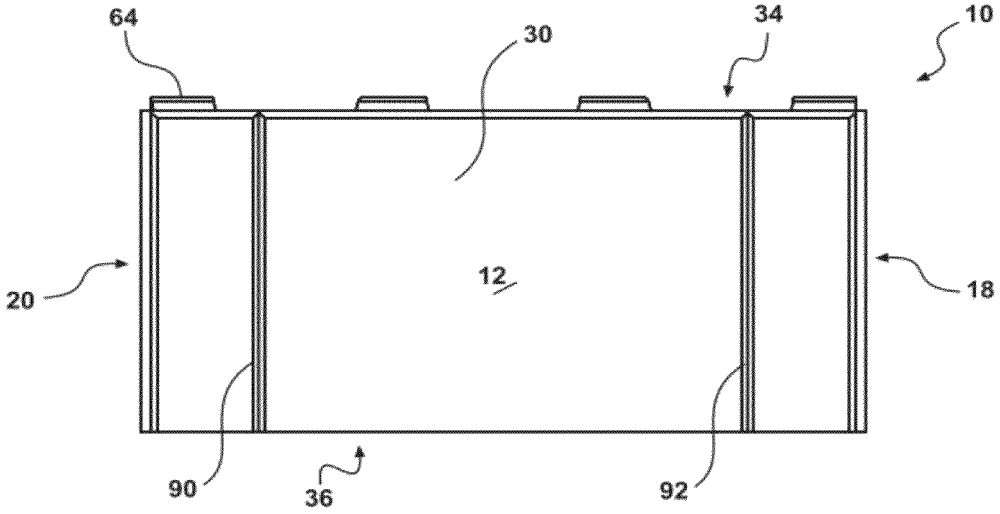
FIG. 7 is a rear view of the masonry block of FIG. 6.
Figure 8:
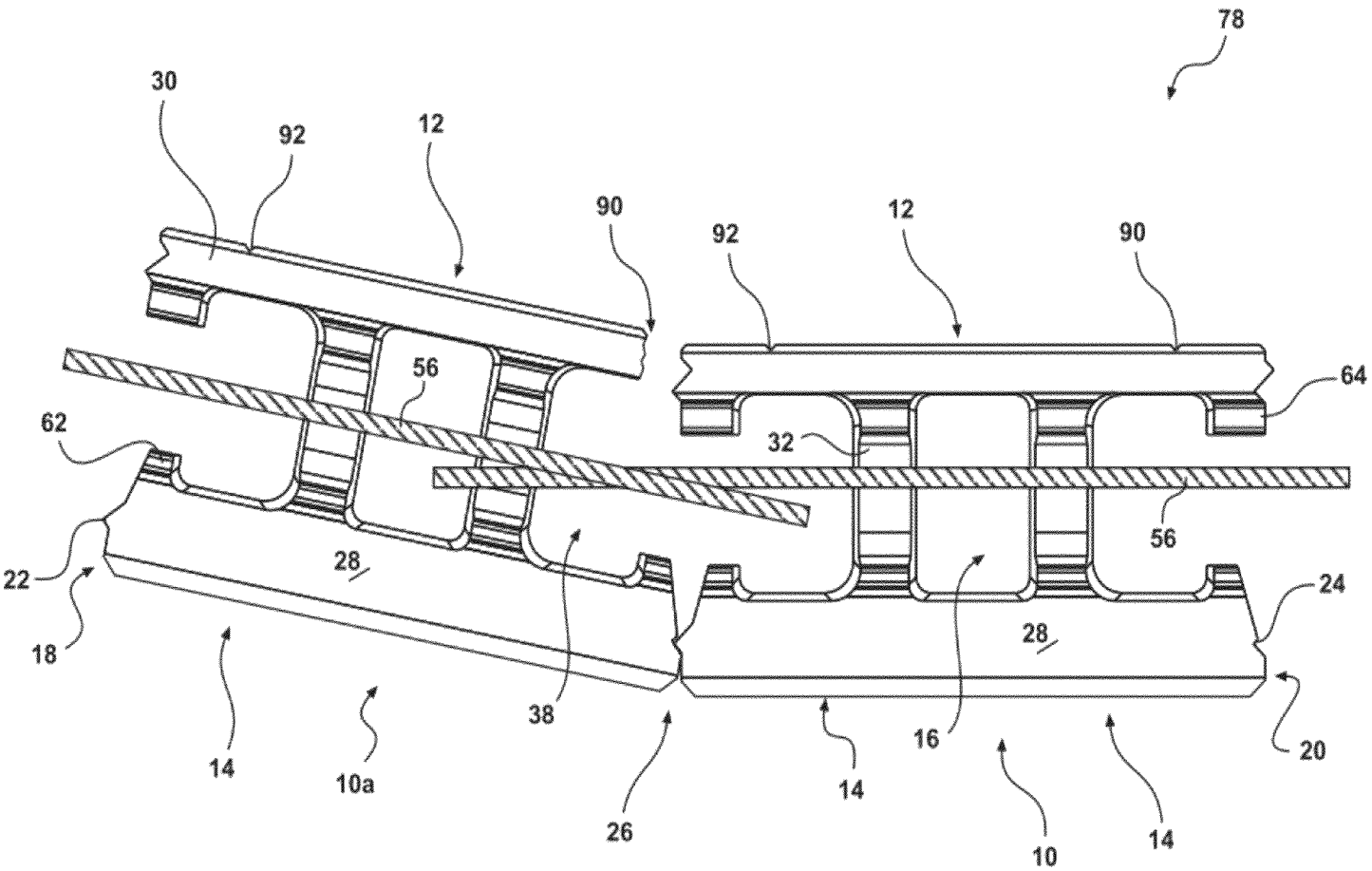
FIG. 8 is a top view of the masonry block of FIG. 6 illustrating the removal of a portion of the rear wall to construct a curved wall.

In still another embodiment as illustrated in FIGS. 6 and 7, the rear wall 30 may include two generally vertical break lines 90, 92 extending down the rear face 12 between the web member 32 and first side 18, and the web member 32 and the second side 20. These two break lines 90, 92 permit portions of the rear wall to be removed such that the front faces 14 of adjacent blocks can be set at an angle greater than 180° in the horizontal plane as illustrated in FIG. 8. This is useful if the wall 78 being constructed requires a gradual curve.

As illustrated in FIG. 8 the protrusion 22 and corresponding shaped docking means 24 of the front wall 28 are shaped so as to be able to register with an abutting block at various angles. The vertical first and second sides 18, 20, adjoining the front face 14, are tapered in the horizontal plane, inwardly of the vertical aperture 38, 40. The protrusion 22 extending outwardly from the first side 18 of block 10 is dimensioned to positively register with the groove 24 of the adjacent block 10*a* at a range of angles while inhibiting movement of flowable concrete out through the vertical interface 26 between the abutting blocks.

One embodiment of the interlocking corner masonry block 84 is illustrated in FIGS. 9 to 14. The corner block 84 includes a rear face 12 generally parallel a front face 14, an end wall 94 with outwardly facing end face 96 generally perpendicular and extending between one side of the rear and front faces 12, 14, an aperture 16 extending vertically through the block 84. Vertical sides 18 adjoining the rear and front faces 12, 14 opposite the end face 96 are registerable with opposing sides of an abutting block 10. The rear wall 30 including parallel, two spaced apart engagement members 98 that extend down the rear face 12 and are registerable with sides of an perpendicularly positioned block 10.

In the present embodiment, due to width constraints of the block for use in a retaining wall the spaced apart engagement members 98 are set in a recessed step 100 in the rear face 12. The corner block 84 may also include a break line 90 down the rear face 12 for removal of a portion of the rear wall 30.

Figure 9:
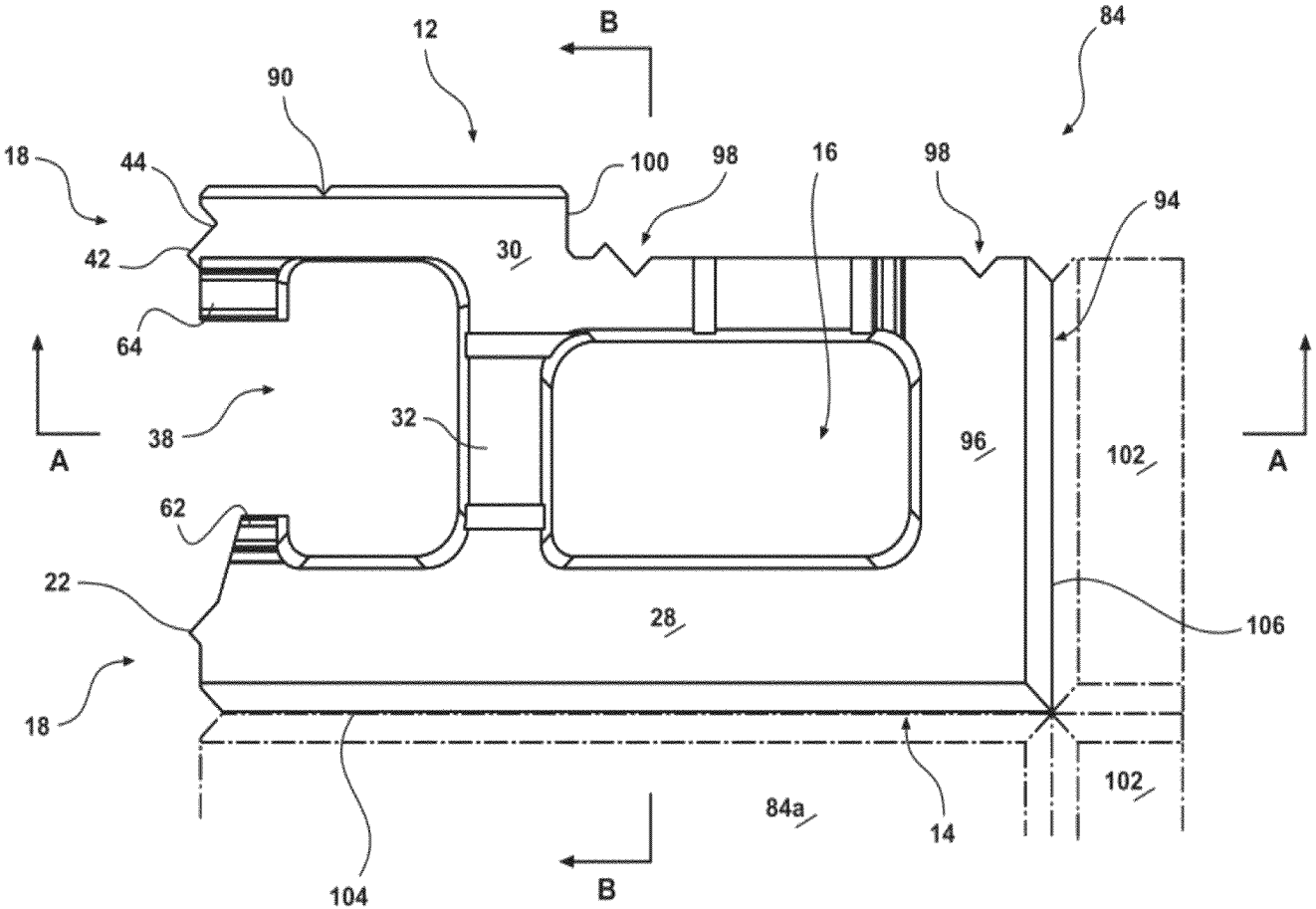
FIG. 9 is a top view of a first embodiment of a corner masonry block illustrating a split face block.
Figure 10:
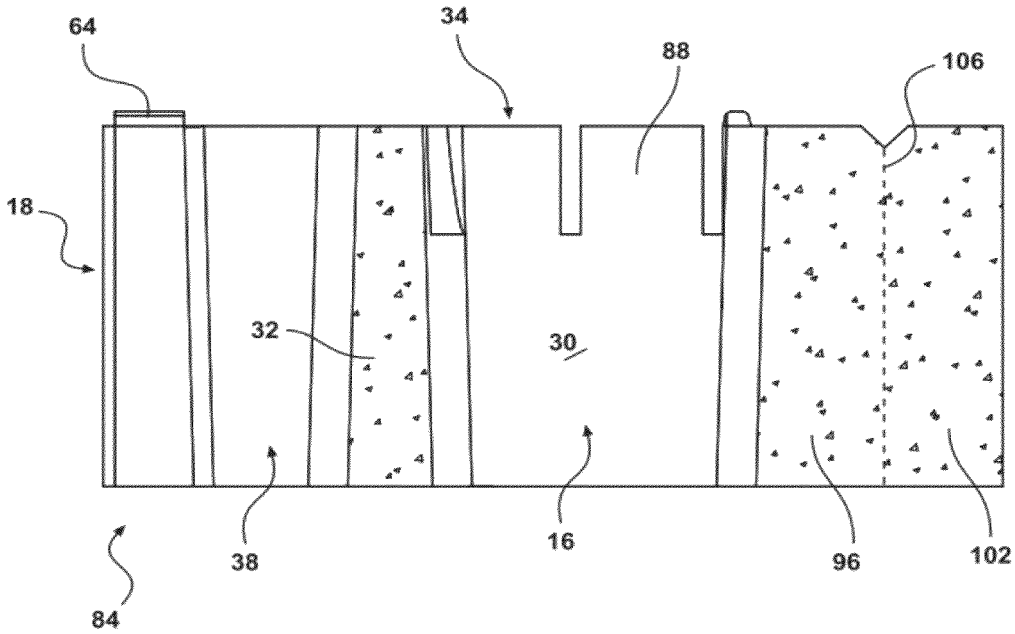
FIG. 10 is a cross section view of the masonry block of FIG. 9 through A-A.
Figure 11:
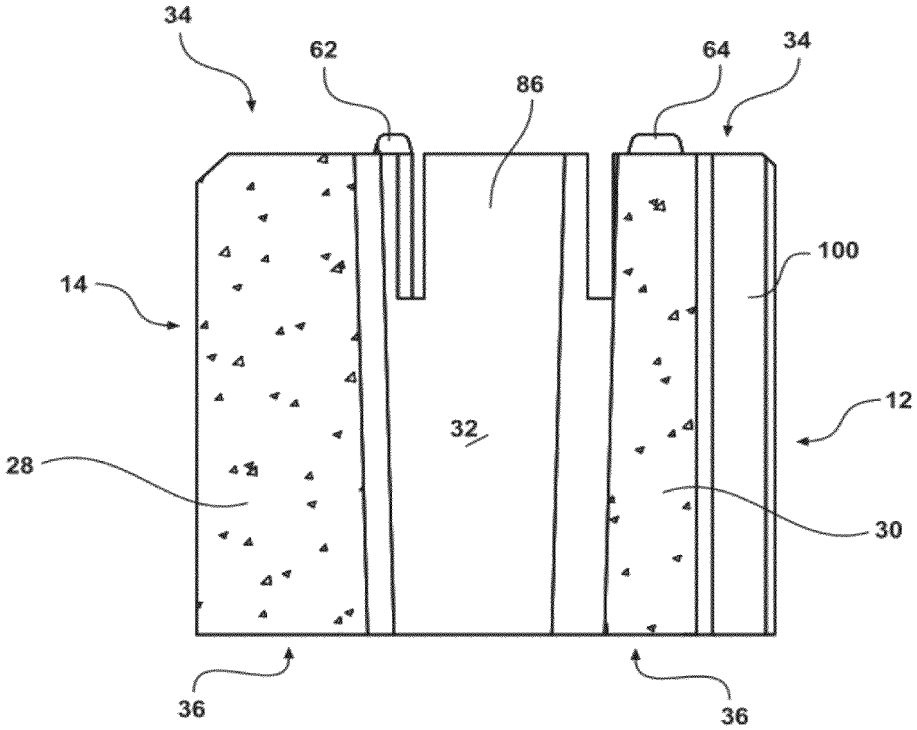
FIG. 11 is a cross section view of the masonry block of FIG. 9 through B-B.
Figure 12:
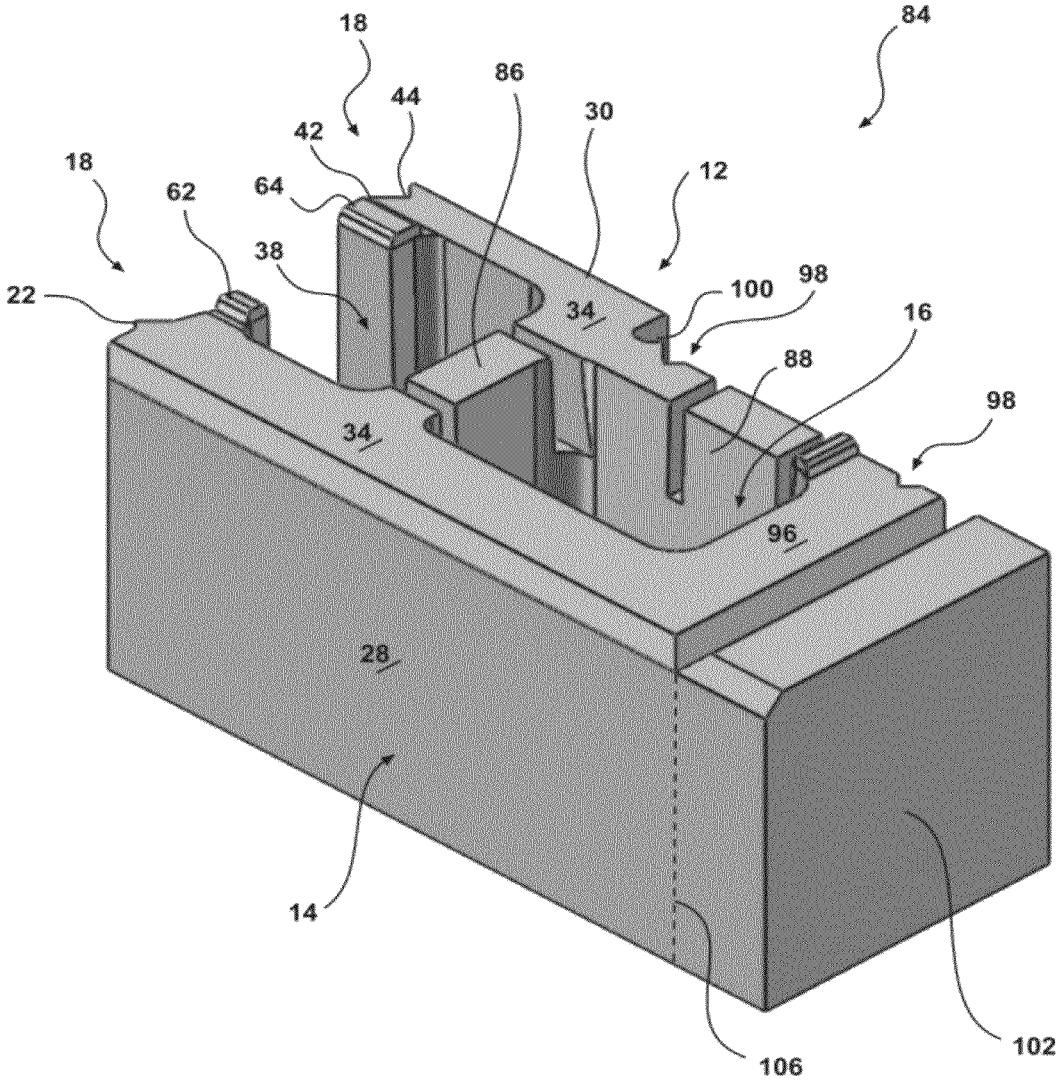
FIG. 12 is a perspective view of the masonry block of FIG. 9 including the end removable portion.

FIG. 9 illustrates a split face block that is moulded as a double block 84, 84*a* with removable end portions 102 delineated by horizontal break lines 104, 106, however it should be appreciated that the corner block 84 may be moulded as a single unit and have front and rear walls of a similar thickness.

Figure 13:
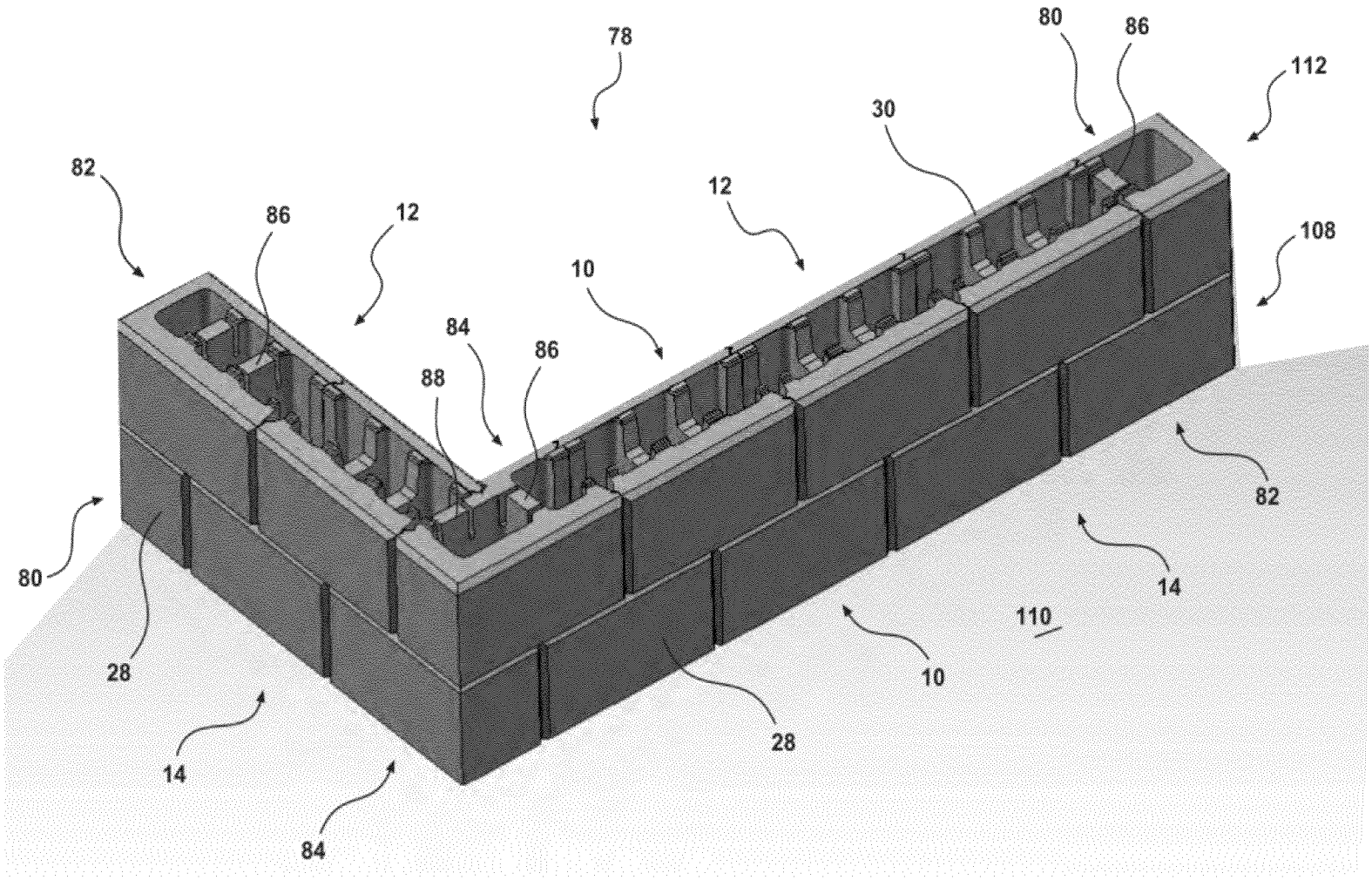
FIG. 13 is a perspective view of a wall constructed using the masonry block of FIG. 9.
Figure 14:
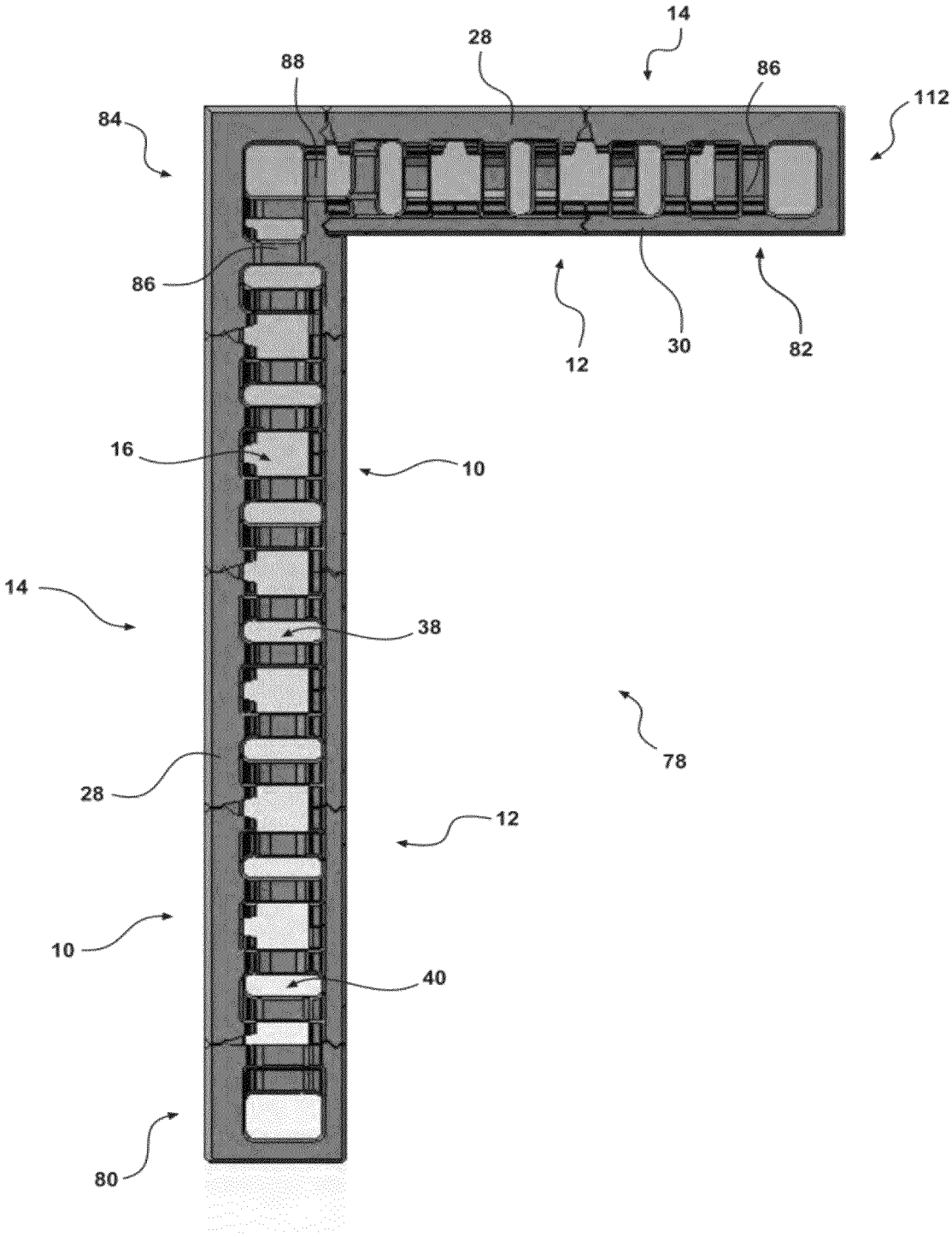
FIG. 14 is a top view of the wall of FIG. 13.

As illustrated in FIGS. 13 and 14 the steel reinforced concrete wall 78 is constructed using dry stacking masonry blocks, including the standard blocks 10, end blocks 80, 82 and corner blocks 84. In the present example the front wall 28 is thicker than the rear wall 30 and therefore the wall is for use as a retaining wall. The reader would however appreciate that any discussion throughout the specification that relates to retaining walls equally applies to walls for buildings and the like.

The user places a first course 108 of interlocking masonry blocks on a foundation 110. Vertical reinforcement bars 58 extending upwardly from the foundation as illustrated in FIG. 4 engage through apertures 16, 38, 40. A length of rebar 56 may also be laid between every second course of blocks to increase strength. The vertical and horizontally rebar pass through the apertures of the blocks to compensate for the lack of tensile strength of the wall.

The abutting blocks of the first course 108 interlock along the vertical interface to inhibit movement of the flowable concrete out between the blocks. A second course 112 of interlocking masonry blocks are then positioned on top of the first course 108 wherein the blocks of the second course engage with the upwardly projecting lugs 62, 64 that extend upwardly from the upper bedding faces 34 of the underlying blocks. The wall 78 can then be core filled by introducing a flowable concrete mixture into the interconnecting vertical apertures 16, 38, 40 of the blocks without blowout of the wall occurring or bleeding out of the concrete through the vertical interfaces.

Figure 15:
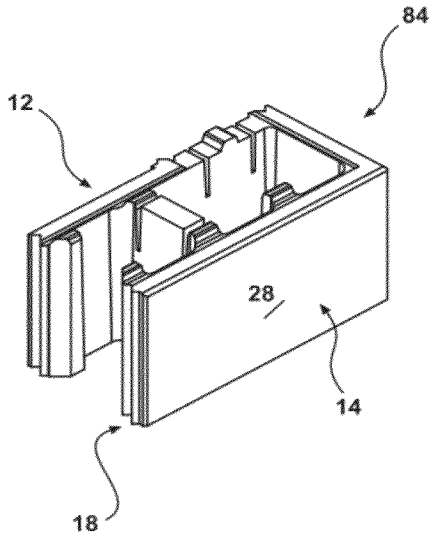
FIG. 15 is a perspective view of a second embodiment of a corner masonry block illustrating a left corner block.
Figure 16:
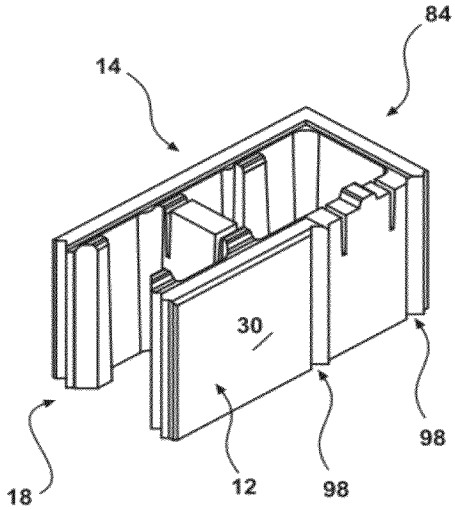
FIG. 16 is a perspective view of the second embodiment of a corner masonry block illustrating a right corner block.
Figure 17:
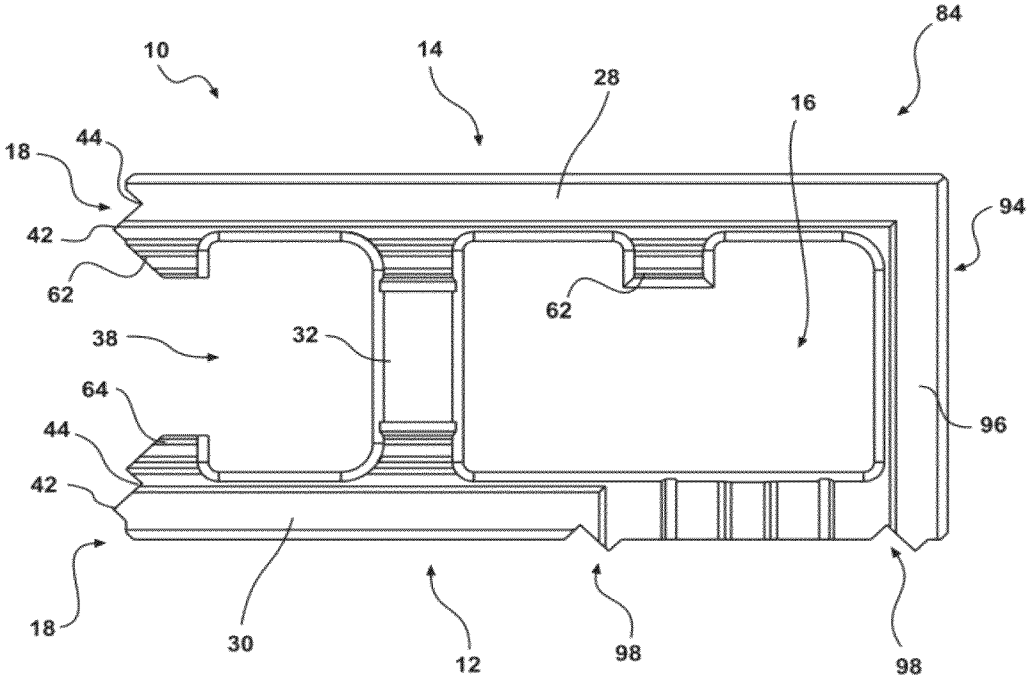
FIG. 17 is a top view of the corner masonry block of FIG. 16.
Figure 18:
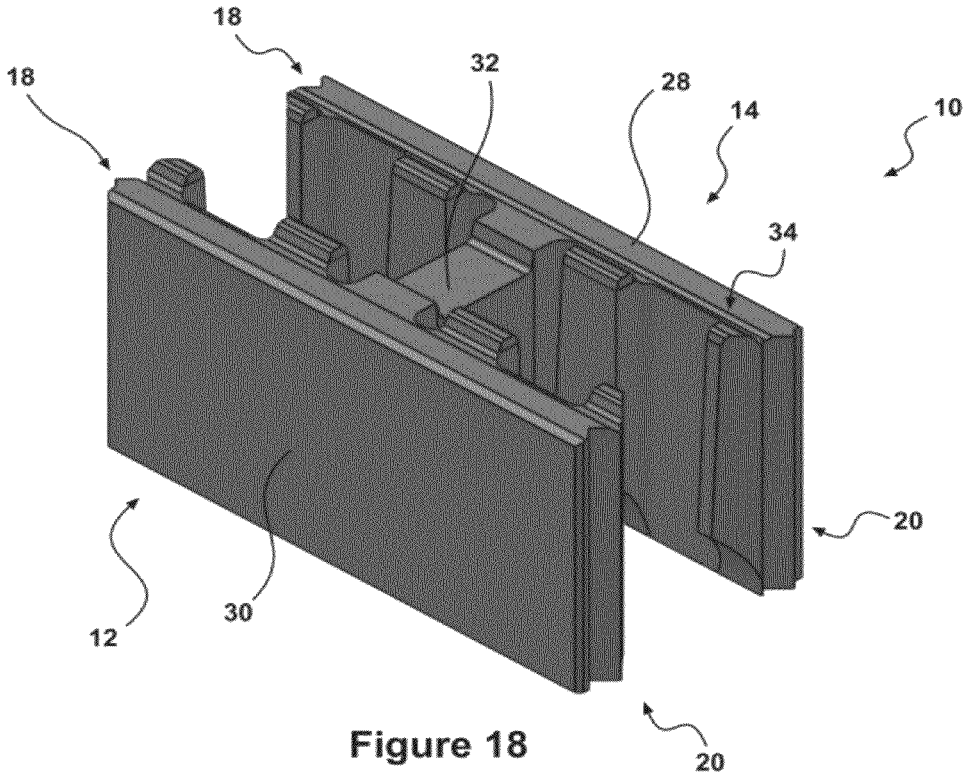
FIG. 18 is a perspective view of a H-block of the present invention.
Figure 19:
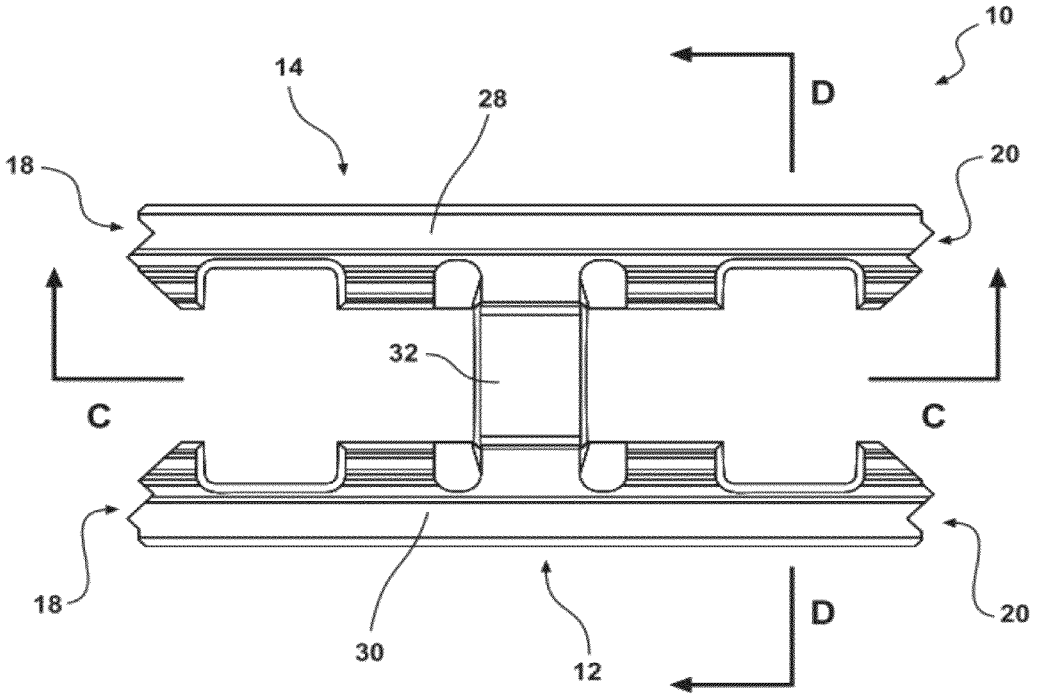
FIG. 19 is a top view of the H-block of FIG. 18.
Figure 20:
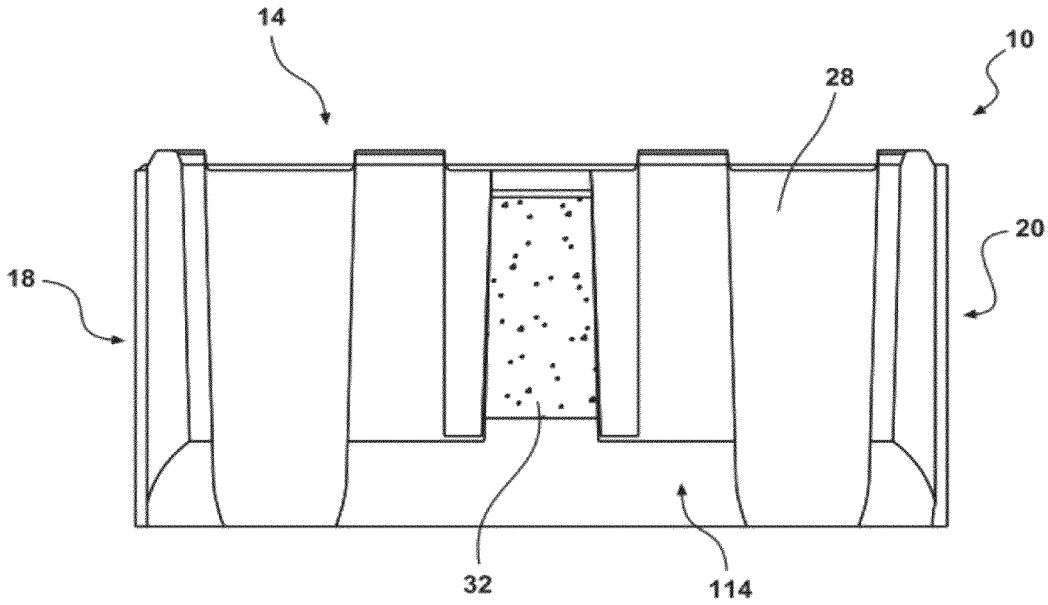
FIG. 20 is a cross-sectional view of the H-block of FIG. 19 through C-C.

FIGS. 15 to 17 illustrate an alternate embodiment of the corner masonry block illustrating left and right corner blocks. As illustrated in the figures the sides 18 adjoining both the front and rear face 12, 14 include a plurality of parallel protrusions 42 separated by grooves 44.

FIGS. 18 to 21 illustrate another embodiment that may be referred to as a H-block. The illustrated interlocking masonry H-block 10 includes a rear wall 12 and front wall 14 connected by a single web member 32. Two sidewardly open apertures extend vertically through the H-block between the rear and front walls 12, 14 for receiving a flowable concrete mixture therethrough that is used in the core filling process.

The vertical sides 18, 20 of the rear wall 12 and the vertical sides 18, 20 of the front wall 14 are registerable with opposing sides of abutting blocks. It should be appreciated by the reader that all the illustrated embodiments may be interconnected depending upon the specific configuration or requirements of the wall being constructed.

Figure 21:
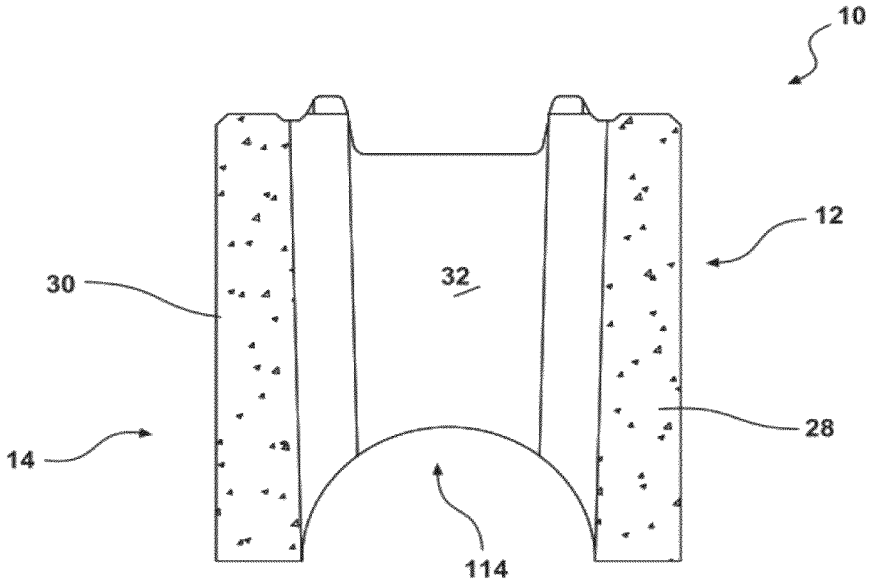
FIG. 21 is a cross-sectional view of the H-block of FIG. 19 through D-D.

As illustrated in FIG. 21, a portion of the web member 32 may be removed after the H-block 10 has been moulded to form an upwardly curved underside 114 of the web member 32. Alternatively the mould may be configured to produce a curved underside. The removal of this portion of the web member 32 reduces the weight of the H-block 10 and provides a passageway for the movement of flowable concrete during core filling of the wall. The removed portion furthermore provides space for the positioning of the steel reinforcement tie bars and the reduction in the weight of the H-block assists in handling during construction of a wall.

The portion of the web member 32 may be removed during production of the H-block 10 when it is removed from a mould using a core puller. The underside of the web member may be arcuate when the portion is removed or it may be angular or multiple portions may be removed. The portion or portions may be removed from the lower section of the web member or the upper portion or both and may be removed after the block has been cured or at least partially cured.

The invention includes the step of dry stacking the masonry H-blocks 10 for use in a mortar-less steel reinforced wall wherein the wall is post-core filled with a flowable concrete mixture. A flowable concrete mixture is pumped into the interconnecting vertical apertures of the blocks 10 using a convention method such as a flexible pipe.

The skilled addressee will now appreciate the many advantages of the illustrated invention. In one aspect the invention provides an interlocking masonry block that inhibits movement of said flowable concrete out through a vertical interface between said blocks. This reduces the construction costs associated with cleaning or treating a surface that has concrete residue attached. Furthermore as the method of laying the block is completely mortar free the internal apertures do not need to be cleaned prior to core filling. The block can also be split faced because the core fill concrete does not seep out through the vertical interface and therefore would not affect the aesthetics of the wall. There is also provided a corner block that provides significant advantages over the prior art in that the user does not need to construct wooden framework at the corners of the wall, or need to affix the blocks, positioned at the corner of the wall, using an adhesive such as mortar. This reduces the time required to build the wall and also means construction can occur independently of the climatic conditions.

Various features of the invention have been particularly shown and described in connection with the exemplified embodiments of the invention, however, it must be understood that these particular arrangements merely illustrate and that the invention is not limited thereto. Accordingly the invention can include various modifications, which fall within the spirit and scope of the invention. It should be further understood that for the purpose of the specification the word "comprise" or "comprising" means "including but not limited to".

The claims defining the invention are as follows:

1. An interlocking masonry block for constructing a wall together with other masonry blocks comprising:

a front wall and a rear wall connected by at least one web member;

at least one aperture extending vertically through said interlocking masonry block for receiving a flowable concrete mixture used in core filling said wall;

the front wall including first and second vertical sides adjoining a front face and the rear wall including first and second vertical sides adjoining a rear face, the first vertical sides of the front and rear walls having first engagement members and the second vertical sides of the front and rear walls having second engagement members, said first and second engagement members registerable with a correspondingly shaped engagement member extending down an opposing side of an abutting block or blocks to inhibit movement of said flowable concrete out through a vertical interface between said interlocking masonry block and said abutting block or blocks;

wherein each of said first engagement members comprise vertical first, second, and third planar portions, said first and third planar portions at an acute angle to said corresponding front or rear face, said first planar portion adjoined to a vertical edge of the second planar portion and said third planar portion adjoined to an opposite vertical edge of said second planar portion, such that said second planar portion is intermediate said first and third planar portions and is at an obtuse angle to said corresponding front or rear face;

wherein each of the second engagement members comprise adjoined vertical first, second, and third planar portions, each of said first, second, and third planar portions being parallel to a corresponding first, second, or third planar portion of said first engagement members; whereby the first and second engagement members are configured to cooperate with said correspondingly shaped engagement member of said abutting block or blocks; and the front and rear walls including respective upper bedding faces, each having a plurality of spaced apart lugs extending upwardly therefrom, or adjacent thereto, for engagement with an underside portion of an overlying block or blocks.

2. The interlocking masonry block in accordance with claim 1, wherein the correspondingly shaped engagement member of said abutting block or blocks inhibit movement of said flowable concrete out through the vertical interface between the abutting blocks without the use of an adhesive or mortar during core filling.

3. The interlocking masonry block in accordance with claim 2, wherein the configuration of the engagement member of the first vertical side of the front wall is the same as that of the second vertical side of the rear wall, and the configuration of the engagement member of the second vertical side of the front wall is the same as that of the first vertical side of the rear wall, whereby the interlocking masonry block is configured to abut either side of said abutting block such that either the front walls align, or the front wall of the interlocking masonry block aligns with the rear wall of the abutting block.

4. The interlocking masonry block in accordance with claim 1, wherein the second planar portion of the first engagement members adjoin the first or third planar portion at an apex to form a protrusion and wherein the second planar portion of the second engagement members adjoin with the first or third planar portion to form a groove; such that said protrusion or said groove is configured to bear against a protrusion or a groove of an adjacent abutting block.

5. The interlocking masonry block in accordance with claim 1, wherein the front and rear walls are configured to be interlocked with adjacent blocks along a single horizontal course of blocks.

6. The interlocking masonry block in accordance with claim 1, wherein two web members extend between the front wall and a rear wall.

7. The interlocking masonry block in accordance with claim 1, wherein the front wall is of a greater thickness than the rear wall.

8. The interlocking masonry block in accordance with claim 1, wherein the front wall is split faced or molded, and the block being used in the construction of a retaining wall.

9. The interlocking masonry block in accordance with claim 1, wherein the rear wall includes two generally vertical break lines extending down the rear face, one between the web member and said first vertical sides, and the other between the web member and the second vertical sides to permit a portion or portions of the rear wall to be removed such that the front face of said interlocking masonry block can be set at an angle greater than 180° to a front face of the abutting block.

10. The interlocking masonry block in accordance with claim 1, wherein the front wall is generally the same thickness as the rear wall.

11. The interlocking masonry block in accordance with claim 1, wherein a portion of the at least one web member are removable to permit the movement of flowable concrete and the positioning of steel reinforcement tie bars onto the at least one web member.

12. The interlocking masonry block in accordance with claim 11, wherein a lower portion of the at least one web member is removed to provide a pathway for the movement of said flowable concrete, and the upper surface of the at least one web member being configured to support one of the steel reinforcement tie bars.

13. The interlocking masonry block in accordance with claim 12, wherein said lower portion of the at least one web member are removed after molding and prior to curing of said interlocking masonry block.

14. The interlocking block in accordance with claim 13, wherein said lower portion of the at least one web member is removed by way of a core puller during removal of said interlocking masonry block from a mold.

15. The interlocking masonry block in accordance with claim 1, wherein the first vertical side of the front wall is spaced apart from the first vertical side of the rear wall by a first aperture extending vertically through said interlocking masonry block for receiving said flowable concrete mixture, and said second vertical side of the front wall is spaced apart from the second vertical side of the rear wall by a second aperture extending vertically through said interlocking masonry block.

16. A method of dry stacking masonry blocks for use in constructing a mortarless steel reinforced concrete wall including the steps of:

providing a plurality of interlocking masonry blocks, each of the plurality of interlocking masonry blocks including a rear wall portion, a front wall portion, an upper bedding face having a plurality of spaced apart upwardly extending lugs, a lower bedding face, at least one vertical aperture extending through said masonry block for permitting passage of reinforcement bars and flowable concrete, the front and rear wall portions each having a first vertical side and an opposite second vertical side, each of said first vertical sides including a first engagement member extending along the length of the first vertical sides, each of said second sides including a complimentary second engagement member expending along the length of the second vertical sides, wherein said first and second engagement members each comprise planar first, second, and third vertical portions, wherein said first and third vertical portions are at an acute or obtuse angle to the respective front or rear wall portion, and the second vertical portion is adjoined between said first and third vertical portions, said second vertical portion at either an obtuse or acute angle, opposite of said first and third vertical portions;

positioning a first course of said plurality of interlocking masonry blocks on a foundation having vertical reinforcement bars extending upwardly therefrom, said first engagement members registering with said second engagement members of adjacent interlocking masonry blocks, the configuration of the first and second engagement members of adjacent interlocking masonry blocks are opposite;

positioning a second course of said plurality of interlocking masonry blocks on top of the first course wherein said plurality of interlocking masonry blocks of the second course engage with at least some of the plurality of spaced apart upwardly projecting lugs of the plurality of interlocking masonry blocks of the first course and at least some of the vertical apertures of the plurality of masonry blocks interconnect;

positioning subsequent courses of said plurality of interlocking masonry blocks thereon; and filling a core of the wall by introducing a flowable concrete mixture into the interconnecting vertical apertures of the plurality of interlocking masonry blocks, wherein the first engagement members bear against the second engagement members of adjacent interlocking masonry blocks to inhibit movement of the flowable concrete out between vertical interfaces between abutting interlocking masonry blocks without requiring mortar to seal said vertical interfaces.

17. The method in accordance with claim 16, further including the step of positioning an interlocking corner masonry block at a corner of the wall, the corner masonry block having a rear wall parallel to a front wall, a first end of said interlocking corner masonry block extending between, and perpendicular to, said front and rear walls and having an outward vertical face, an aperture extending vertically through said corner masonry block for receiving the flowable concrete mixture, and a vertical second end, opposite said first end, being registerable with one of said first or second vertical sides of an abutting interlocking masonry block, wherein the rear wall including spaced apart engagement members extending down said rear wall, said engagement members registerable with one of said first or second sides of a second abutting interlocking masonry block to inhibit movement of said flowable concrete out through a vertical interface between said interlocking corner masonry block and said second abutting interlocking masonry block.

18. The method in accordance with claim 16, wherein at least one end of the front and rear walls of each of the plurality of interlocking masonry blocks is spaced apart to allow the flow of the concrete mixture therethrough, whereby the concrete mixture once cured, connects each horizontal course and connects the plurality of interlocking masonry blocks in each course by way of the concrete mixture that extends between and outwardly from the at least one end.

* * * * *